US006086124A

United States Patent [19]

Wang

[11] Patent Number: 6,086,124

[45] Date of Patent: Jul. 11, 2000

[54] CARRYING ASSEMBLY FOR BOTTLES OR THE LIKE

[76] Inventor: Jinn Yih Wang, 119, Tarn Beei Road, Ho Mei Cheng, Chang Hua Hsien, Taiwan

[21] Appl. No.: 09/108,198

[22] Filed: Jul. 1, 1998

Related U.S. Application Data

[63] Continuation-in-part of application No. 09/003,326, Jan. 6, 1998, abandoned.

[51] Int. Cl.[7] ..... B65D 23/10

[52] U.S. Cl. ..... 294/33; 294/27.1; 215/396; 224/148.4

[58] Field of Search ..... 294/27.1, 31.2, 294/33, 90, 91, 137, 149, 166; 215/395, 396, 399; 224/148.1, 148.4, 148.5, 148.6, 148.7; 248/312, 313

[56] References Cited

U.S. PATENT DOCUMENTS

| | | | |
|---|---|---|---|
| D. 286,859 | 11/1986 | Wu | 294/31.2 |
| 1,432,413 | 10/1922 | Riggs | 294/33 |
| 1,890,482 | 12/1932 | Weissberg | 215/399 |
| 5,203,481 | 4/1993 | Dobbins et al. | 294/31.2 |
| 5,390,838 | 2/1995 | Jafarkhani | 224/148.4 |
| 5,413,261 | 5/1995 | Wu | 294/31.2 |
| 5,577,647 | 11/1996 | Pittarelli et al. | 224/148.6 |
| 5,765,888 | 6/1998 | Stack | 294/27.1 |
| 5,890,635 | 4/1999 | Wu et al. | 224/148.4 |

*Primary Examiner*—Dean J. Kramer
*Attorney, Agent, or Firm*—Birch, Stewart, Kolasch & Birch, LLP

[57] ABSTRACT

A carrying assembly for bottles or the like includes a generally C-shaped clamping element and a carrying strap. The clamping element is provided with an opening portion that is less than one half of a circle with lugs extending outwardly from both sides thereof. The lugs are each provided with an elongated slot. The two ends of the carrying strap may pass through the elongated slots and be secured in position to facilitate carrying of a bottle. The carrying strap and the lugs may also be fastened together by adhering the ends of the carrying strap to the lugs using ultrasonic waves. The distal ends or sides of the lugs may be provided with a cover plate that has a bottom portion at least partly connected to the lugs and a notch at an upper side for receiving the ends of the carrying strap. Ultrasonic waves are then used to secure the cover plates, the carrying strap and the lugs as a whole.

6 Claims, 7 Drawing Sheets

CARRYING ASSEMBLY FOR BOTTLES OR THE LIKE

BACKGROUND OF THE INVENTION

The present invention is a continuation-in-part of U.S.A. Ser. No. 09/003,326 filed Jan. 6, 1998 for "Carrying Assembly for Bottle or the Likes, now abandoned."

SUMMARY OF THE INVENTION

According to the first aspect of the present invention, the carrying assembly of the present invention essentially comprises a generally C-shaped clamping element and a carrying strap. The clamping element has an opening portion, which is less than one half of a circle and two lugs respectively which extend outwardly from both sides of the clamping element. The lugs each have an elongated slot, and the carrying strap has two ends which may pass through the elongated slots of the lugs respectively and be secured in position. The clamping element is fastenable to a neck portion below an opening of a bottle to facilitate carrying of the bottle.

According to the second aspect of the present invention, the lugs on both sides of the clamping element extend outwardly to be perpendicular to the opening portion of the clamping element and the elongated slots thereof are oriented in a horizontal direction.

According to the third aspect of the present invention, the lugs on both sides of the clamping element extend outwardly to be parallel to the opening portion of the clamping element and the elongated slots thereof are oriented in a vertical direction.

According to the fourth aspect of the present invention, the lugs on both sides of the clamping element extend outwardly to be perpendicular to the opening portion of the clamping element and the elongated slots thereof are oriented in a vertical direction.

According to the fifth aspect of the present invention, the two ends of the carrying strap are adhered to the lugs using ultrasonic waves to facilitate carrying of the bottle.

According to the sixth aspect of the present invention, the distal ends of the lugs on both sides of the clamping element may be provided with respective cover plates each having a bottom portion having at least a part thereof connected to the respective one of the lugs and a notch at an upper side for receiving the ends of the carrying strap. The cover plates, the carrying strap, and the lugs are secured together as a whole using ultrasonic waves.

According to the seventh aspect of the present invention, between the lugs and the cover plates, there is at least one side provided with an indentation for receiving the carrying strap so that a neat and smooth appearance can be achieved when the cover plates, the carrying strap and the lugs are secured as a whole.

According to the eighth aspect of the present invention, between the lugs and the cover plates, there is at least one side provided with raised vein portions so that a stronger coupling force can be achieved when the cover plates, the carrying strap, and the lugs are secured as a whole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and other features and advantages of the present invention will be more clearly understood from the following detailed description and the accompanying drawings which are given by way of illustration only, and thus are not limitive of the present invention, and in which.

DETAILED DESCRIPTION OF THE PREFERRED EMBODIMENT

Figure 1:
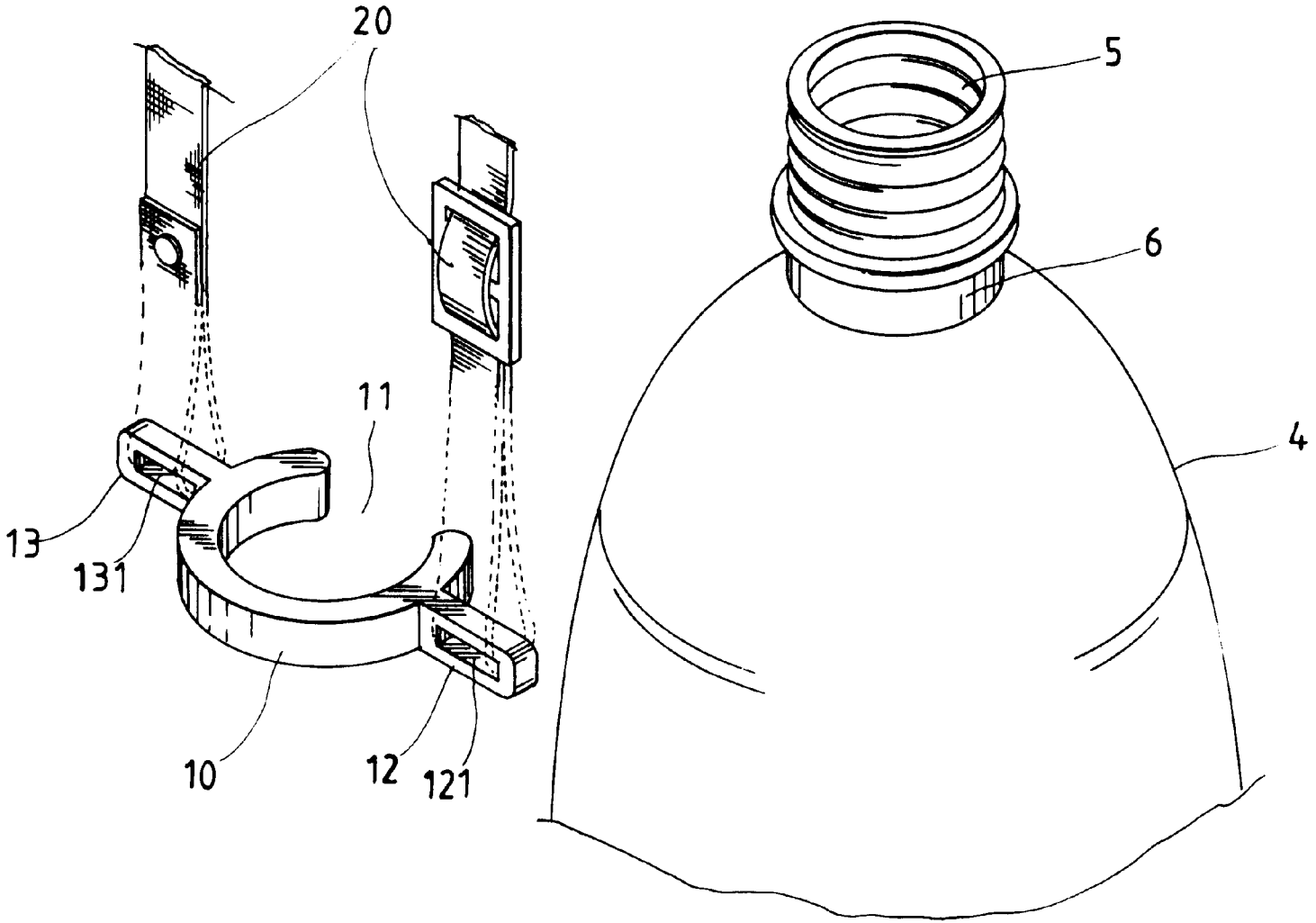
FIG. 1 is a perspective view of a preferred embodiment of the carrying assembly according to the present invention.
Figure 2:
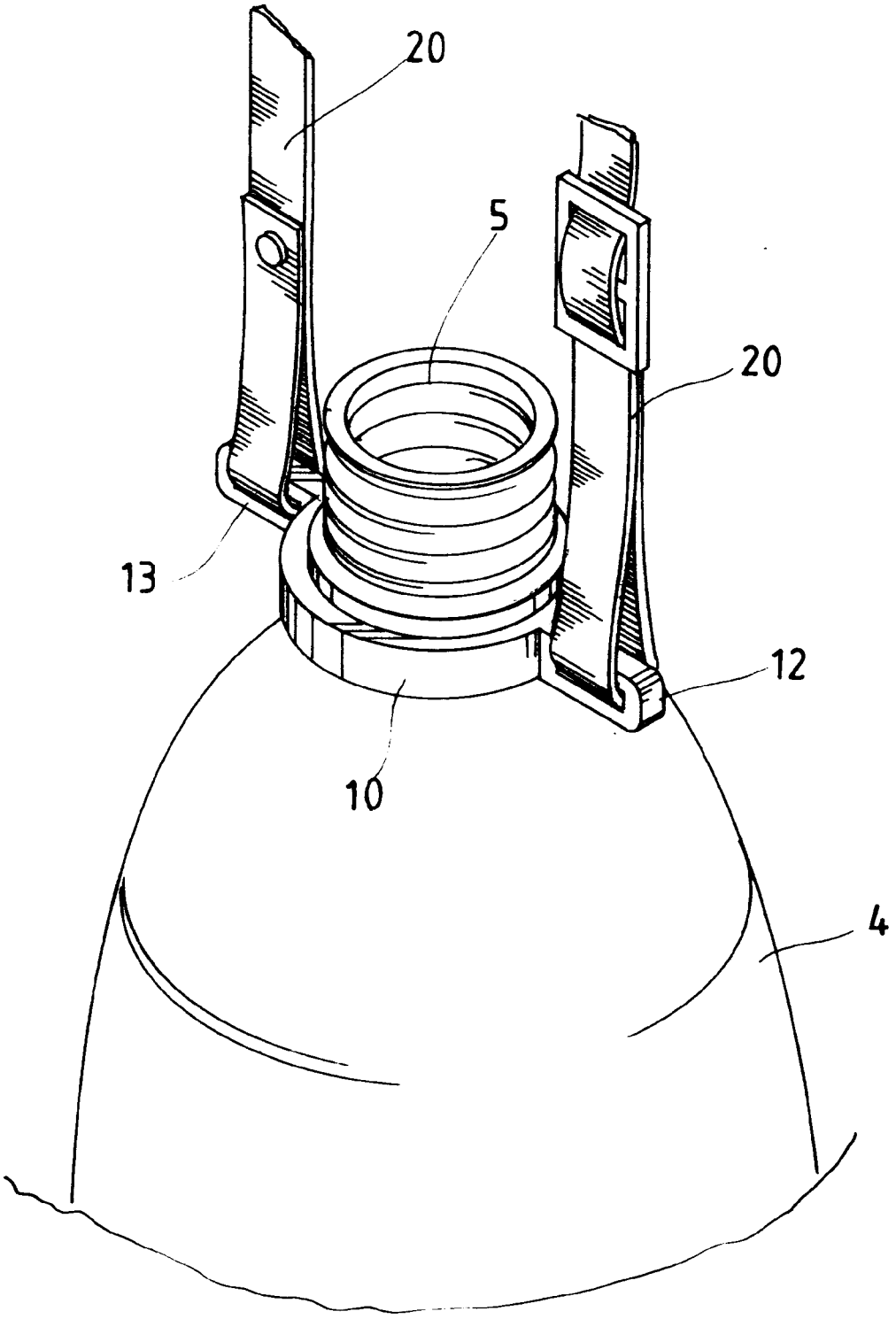
FIG. 2 is a perspective view showing the carrying strap fastened to a bottle.

With reference to FIGS. 1 and 2, the carrying assembly according to the present invention essentially comprises, as in the case of the parent application, a substantially C-shaped clamping element 10 and a carrying strap 20. The clamp element 10 is provided with an opening portion 11 which is less than one-half of a circle. Two lugs 12, 13 having elongated slots 121, 131 respectively extend outwardly from the clamp element 10 at suitable positions. The carrying strap 20 has two ends 21, 22 respectively passing through the elongated slots 121, 131 of the lugs 12, 13. The clamping element 10 is utilized to fasten to a neck portion 6 below an opening 5 of a bottle 4 such as a PE bottle. The carrying strap 20 is adapted to carry the bottle 4.

Figure 3:
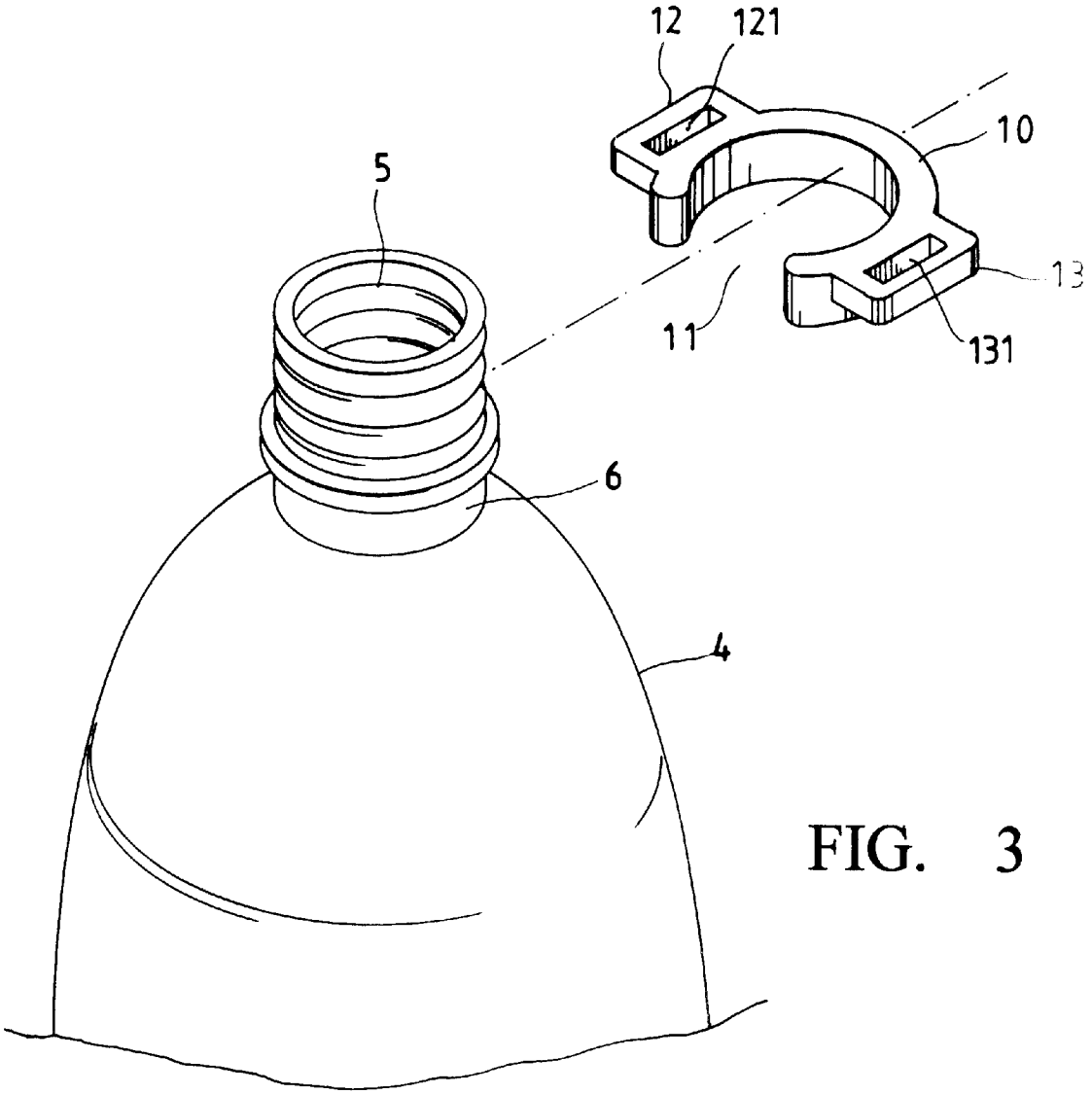
FIG. 3 is a perspective view of another preferred embodiment of the carrying assembly according to the present invention.
Figure 4:
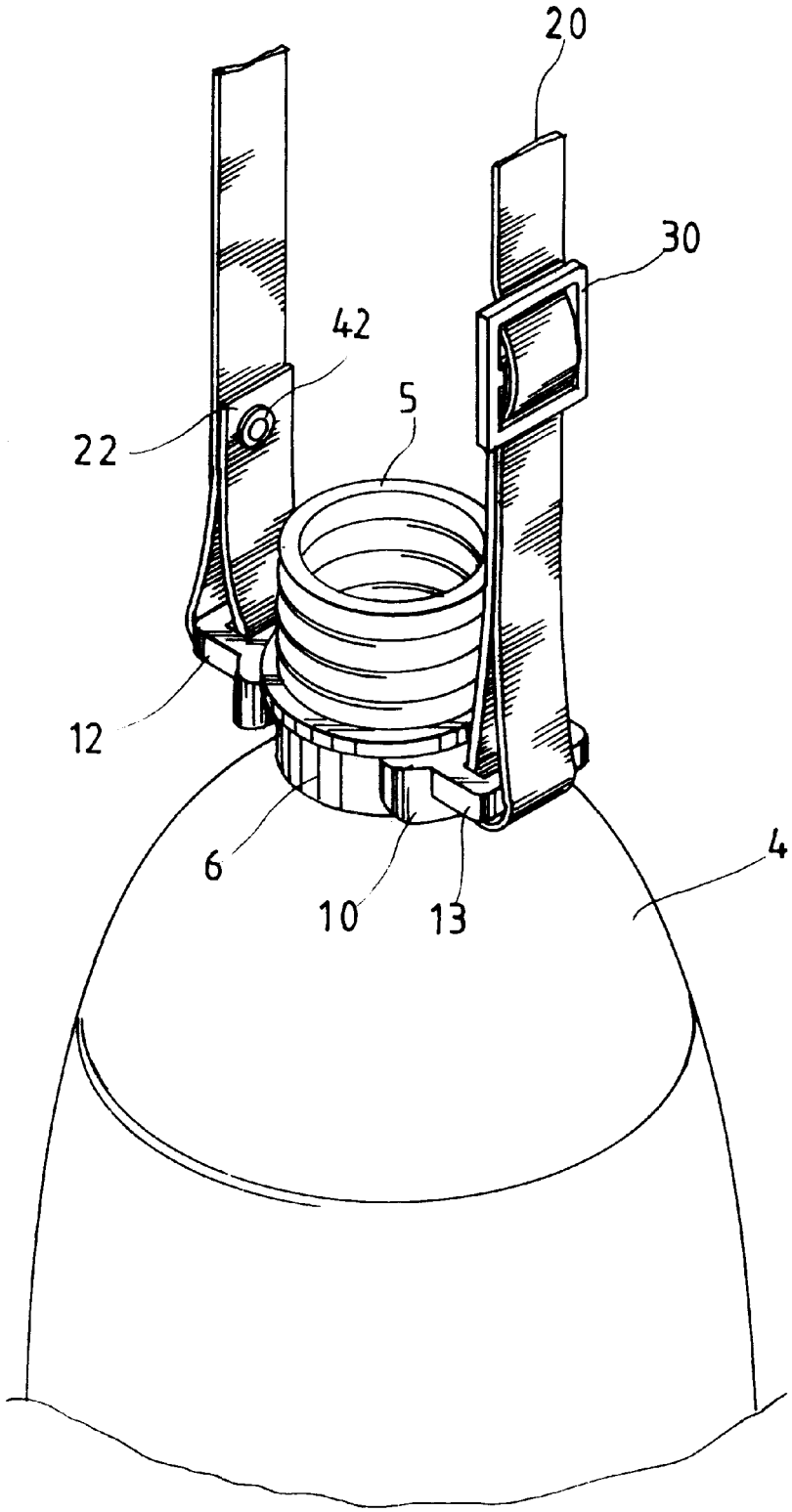
FIG. 4 is a perspective view of another preferred embodiment of the present invention in which the carrying strap is fastened to the bottle.
Figure 5:
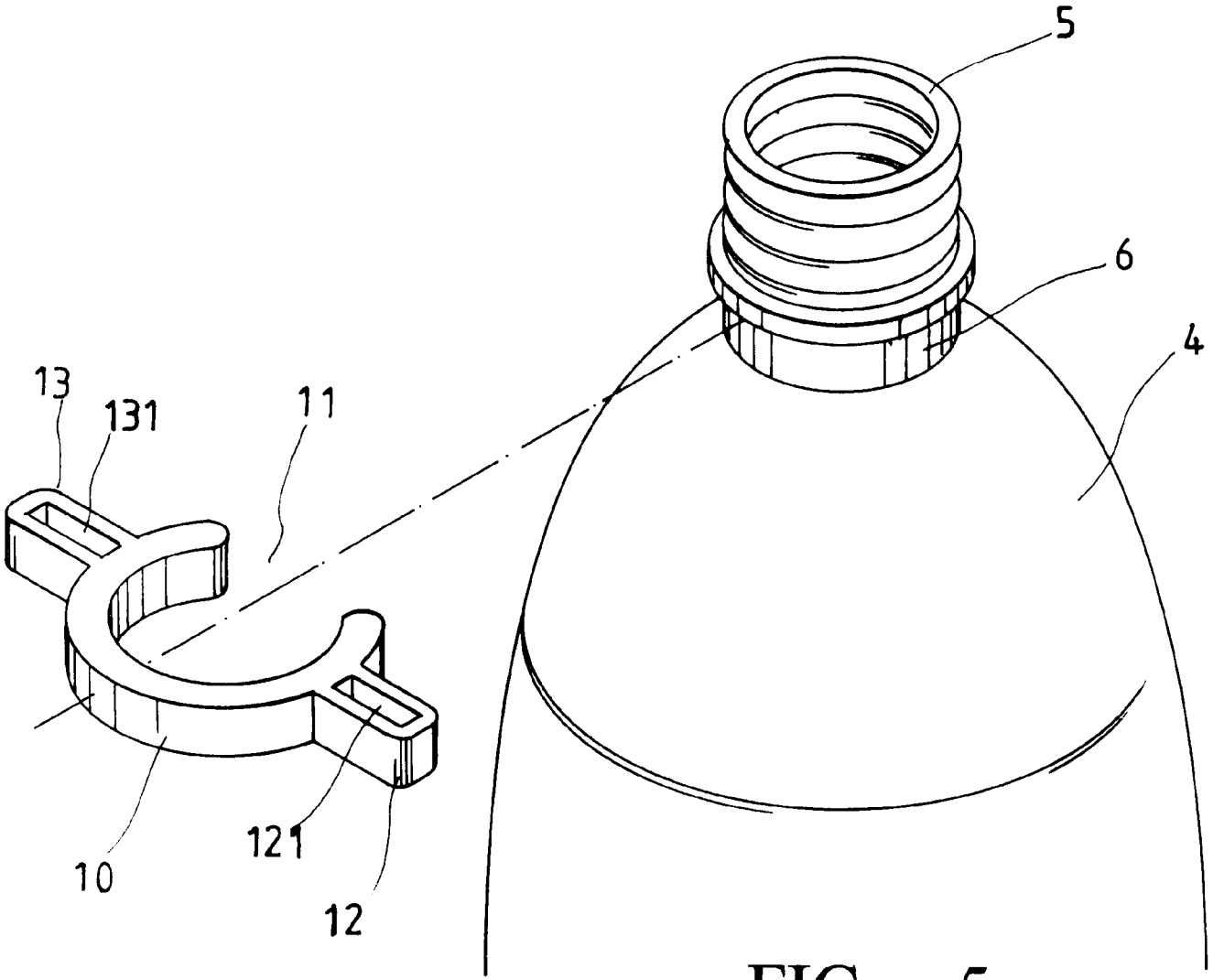
FIG. 5 is a perspective view of still another preferred embodiment of the carrying assembly according to the present invention.

There are various embodiments of the lugs 12, 13 at both sides of the clamp element 10. With reference to FIGS. 3 and 4, the lugs 12, 13 extend outwardly from the clamping element 10 near its ends and are parallel to the direction of the opening 11 of the clamping element 10, and the elongated slots 121, 131 of the lugs 12, 13 are in a horizontal direction. Referring to FIG. 5, the lugs 12, 13 thereof extend outwardly and are substantially perpendicular to the direction of the opening 11 of the clamping element 10, and the elongated slots 121, 131 thereof being substantially perpendicular to the opening 11 as well. Both embodiments can achieve the same objects described hereinabove.

Figure 6:
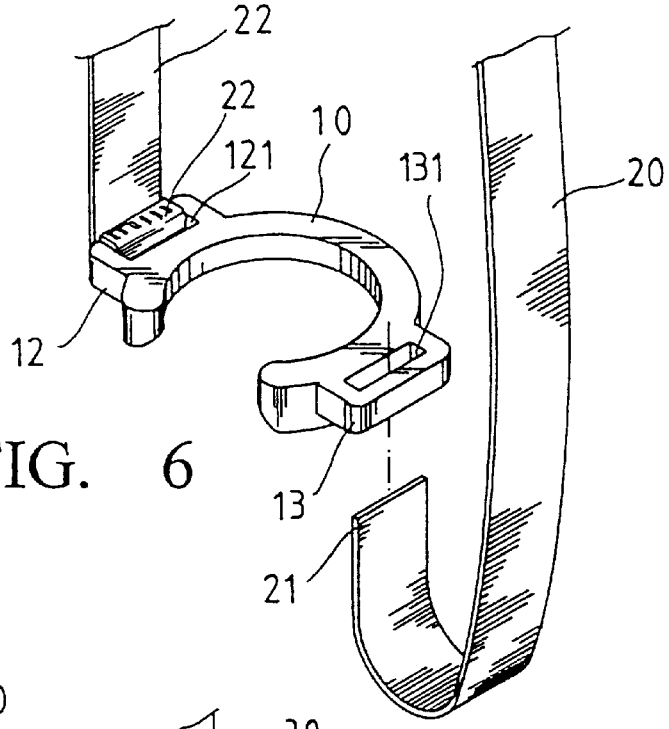
FIG. 6 is a perspective view illustrating one way of securing the carrying strap to lugs of the clamping element.
Figure 7:
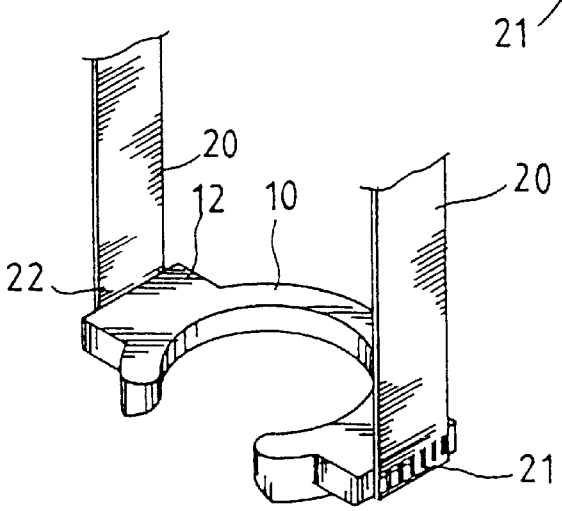
FIG. 7 is a perspective view illustrating another way of securing the carrying strap to the lugs of the clamping element.
Figure 8:
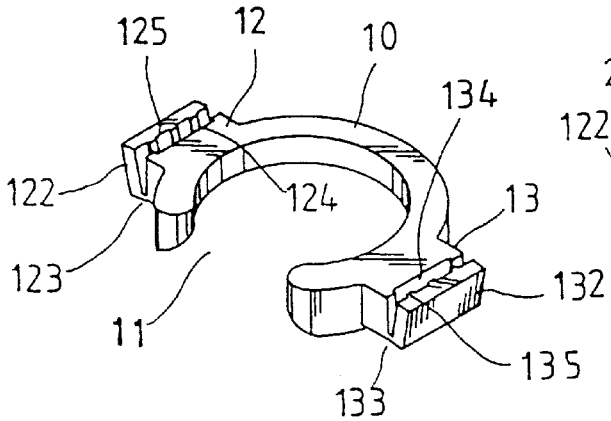
FIG. 8 is a perspective view illustrating that the outer sides of the lugs are provided with cover plates.
Figure 9:
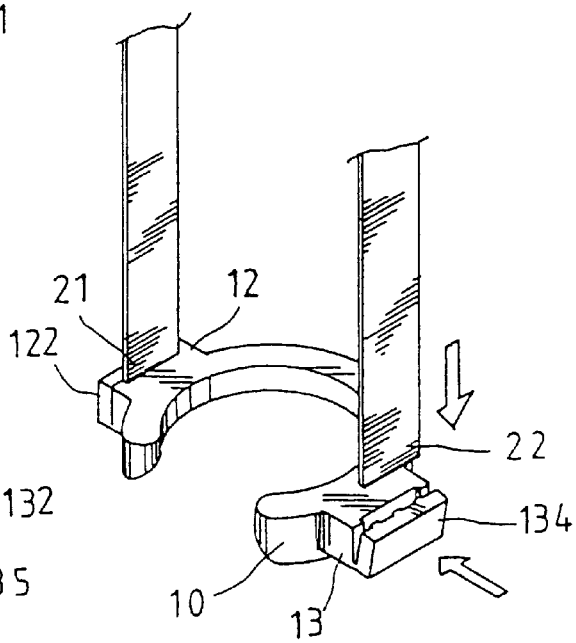
FIG. 9 is a perspective view illustrating how the ends of the carrying strap, the lugs of the clamping element and the cover plates are secured.
Figure 11:
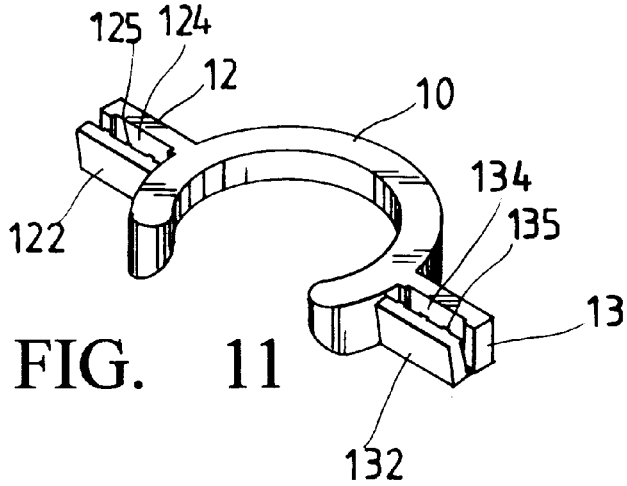
FIGS. 10–12 are perspective views illustrating how the carrying strap is secured to the lugs when the lugs are oriented in a longitudinal direction.
Figure 12:
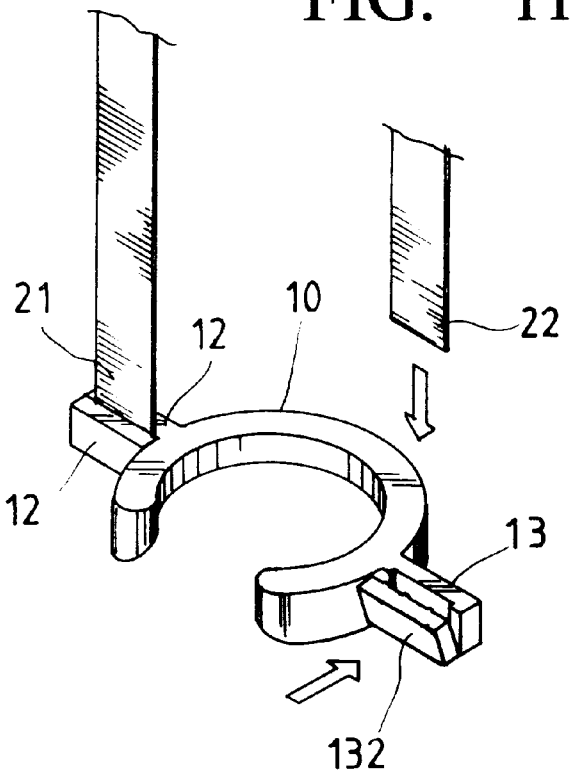
Figure 10:
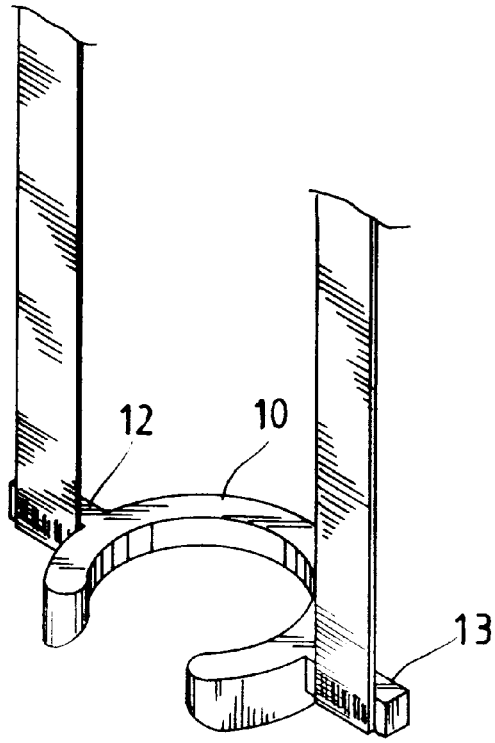

With reference to FIG. 6, the two ends 21, 22 of the carrying strap 20 may be adhered to the outer edges of the lugs 12, 13 using ultrasonic waves after being passed through the elongated slots 121, 131. Certainly, the lugs 12, 13 may not be provided with any elongated slots and the ends 21, 22 of the carrying strap 20 may be directly adhered to the distal ends of the outer edges of the lugs 12, 13 using ultrasonic waves, as shown in FIG. 7. Alternatively, as shown in FIG. 10, the ends 21, 22 may be adhered to the lateral sides of the lugs 12, 13. In addition, the distal ends of the lugs 12, 13 as shown in FIGS. 8 and 9 or the lateral sides of the lugs 12, 13 as shown in FIGS. 11 and 12 may be provided with cover plates 122, 132 having respective bottom portions 123, 133 which have at least one part thereof connected to the corresponding lugs 12, 13 and a notch at an upper side for receiving the ends 21, 22 of the carrying strap 20. The cover plates 122, 132, the ends 21, 22 of the carrying strap 20, and the lugs 12, 13 are then secured as a whole using ultrasonic waves, wherein at least one side (at the side of the respective lugs as in this embodiment) between the lug 12, 13 and the cover plates 122, 132, there is provided an indentation 124, 134 for receiving ends 21, 22 of the carrying strap 20 so that when the cover plates 122, 132, the ends 21, 22 of the carrying strap 20, and the lugs 12, 13 are secured as a whole, a neat and smooth appearance can be achieved. Furthermore, at least one side (at the side of the respective cover plates in this embodiment) between the lugs and the cover plates, there is provided raised vein portions 125, 135 so that when the cover plates 122, 132, the ends 21, 22, and the lugs 12, 13 are secured as a whole, they may be fused together to achieve a stronger coupling force.

Although the present invention has been illustrated and described with reference to the preferred embodiment thereof, it should be understood that it is in no way limited to the details of such embodiment but is capable of numerous modifications within the scope of the appended claims.

What is claimed is:

1. A carrying assembly for bottles, comprising a substantially C-shaped clamping element and a carrying strap, said clamping element having an opening portion which is less than one half of a circle and two lugs respectively which extend outwardly from both sides of said clamping element, said lugs on both sides of said clamping element being provided with respective cover plates, each of the cover plates having a bottom portion connected to the respective one of said lugs, a notch being formed between the respective lug and the cover plate, said carrying strap having two ends which are received in the notches and are securable in position, said clamping element being fastenable to a neck portion below an opening of a bottle to facilitate carrying of the bottle.

2. The carrying assembly for bottles as defined in claim 1, wherein said lugs on both sides of said clamping element extend outwardly to be perpendicular to said opening portion of said clamping element and said notches thereof are oriented in a horizontal direction.

3. The carrying assembly for bottles as defined in claim 1, wherein said lugs on both sides of said clamping element extend outwardly to be perpendicular to said opening portion of said clamping element.

4. The carrying assembly for bottles as defined in claim 1, wherein, between said lugs and said cover plates, at least one side is provided with an indentation for receiving said carrying strap so that a neat and smooth appearance can be achieved when said cover plates, said carrying strap, and said lugs are secured as a whole.

5. The carrying assembly for bottles as defined in claim 1, wherein, between said lugs and said cover plates, at least one side is provided with raised vein portions so that a stronger coupling force can be achieved when said cover plates, said carrying strap, and said lugs are secured as a whole.

6. The carrying assembly for bottles as defined in claim 1, wherein the cover plates, the carrying strap and the lugs are secured together as a whole using ultrasonic waves.

* * * * *